US007317401B2

(12) United States Patent
Germann et al.

(10) Patent No.: US 7,317,401 B2
(45) Date of Patent: Jan. 8, 2008

(54) METHOD AND MECHANICAL TAMPER-EVIDENT CASE FASTENER

(75) Inventors: Philip Raymond Germann, Oronoco, MN (US); Mark James Jeanson, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 260 days.

(21) Appl. No.: 11/246,823

(22) Filed: Oct. 7, 2005

(65) Prior Publication Data

US 2007/0080821 A1 Apr. 12, 2007

(51) Int. Cl.
*G08B 21/00* (2006.01)

(52) U.S. Cl. ..... 340/652; 340/568.1; 70/333 R

(58) Field of Classification Search ..... 340/652, 340/524, 539.31, 545.6, 568.1, 572.9; 70/333 R
See application file for complete search history.

(56) References Cited

U.S. PATENT DOCUMENTS 6,087,939 A * 7/2000 Leyden et al. ..... 340/568.2
6,407,666 B1 * 6/2002 Debrody et al. ..... 340/568.4
6,956,479 B2 * 10/2005 Kelsch et al. ..... 340/568.1
2004/0066296 A1 * 4/2004 Atherton ..... 340/572.1
2006/0265953 A1 * 11/2006 Hobbs ..... 48/127.3

* cited by examiner

*Primary Examiner*—Phung T. Nguyen
(74) *Attorney, Agent, or Firm*—Joan Pennington

(57) ABSTRACT

A method and apparatus are provided for identifying product tampering. A mechanical fastening screw, a sleeve and a movable follower disk are arranged to show evidence of tampering. The movable follower disk is received within a cavity defined by the sleeve. The sleeve includes a channel and a final resting slot defined within a sleeve wall. The movable follower disk includes compressible spring followers slideably received within the channel when the mechanical fastening screw is inserted. If the screw is removed, the compressible spring followers engage the final resting slot to indicate tampering. Electrical detection of the compressible spring followers engaging the final resting slot is used to identify tampering.

20 Claims, 15 Drawing Sheets

METHOD AND MECHANICAL TAMPER-EVIDENT CASE FASTENER

FIELD OF THE INVENTION

The present invention relates generally to the data processing field, and more particularly, relates to a method and apparatus for identifying product tampering.

DESCRIPTION OF THE RELATED ART

When supporting products with warranties, it is useful to be able to determine if the customer has opened or modified the product in any way. For example, game systems, such as PlayStation, Xbox, and the like, owners will often open their systems to improve performance.

A common way of obtaining this information requires placing a label over the seam of the external packaging of the product. Such a solution is not practical for small devices, such as hand-held computers, because placement of a label may be difficult without covering a functional area of the device, and also could be defeated by applying a duplicate label.

The use of a label can adversely affect the overall function or aesthetics of the product. In addition, day-to-day use of the device can lead to natural wearing-out of the label, compromising the ability of the warrantor to accurately detect tampering.

An alternative, effective method for identifying product tampering is needed.

SUMMARY OF THE INVENTION

Principal aspects of the present invention are to provide a method and apparatus for identifying product tampering. Other important aspects of the present invention are to provide such method and apparatus for identifying product tampering substantially without negative effect and that overcome many of the disadvantages of prior art arrangements.

In brief, a method and apparatus are provided for identifying product tampering. A mechanical fastening screw, a sleeve and a movable follower disk are arranged to show evidence of tampering. The movable follower disk is received within a cavity defined by the sleeve. The sleeve includes a channel and a final resting slot defined within a wall of the sleeve. The movable follower disk includes compressible spring followers slideably received within the channel when the mechanical fastening screw is inserted. If the screw is removed, the compressible spring followers engage the final resting slot to indicate tampering.

In accordance with features of the invention, the apparatus for identifying product tampering enables an electrical detection of product tampering, and also generally prevents a user violator from knowing of its existence, thereby preventing circumvention.

In accordance with features of the invention, the apparatus for identifying product tampering includes detect logic for electrical detection of the compressible spring followers engaging the final resting slot to indicate tampering.

In accordance with features of the invention, the overall function or aesthetics of the product is not affected by the apparatus for identifying product tampering, with the use of labels eliminated.

In accordance with features of the invention, the compressible spring followers engage the final resting slot due to a counter force of a spring opposing the mechanical fastening screw.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In accordance with features of the preferred embodiments, the apparatus for identifying product tampering provides advantages over prior art arrangements. Firstly, the apparatus for identifying product tampering in accordance with the preferred embodiment does not affect the overall function or aesthetics of the product, with the use of tamper indicating labels eliminated. Secondly, the apparatus for identifying product tampering in accordance with the preferred embodiment enables an electrical detection method, preventing the violator from knowing of its existence, and also thereby preventing circumvention.

Figure 1:
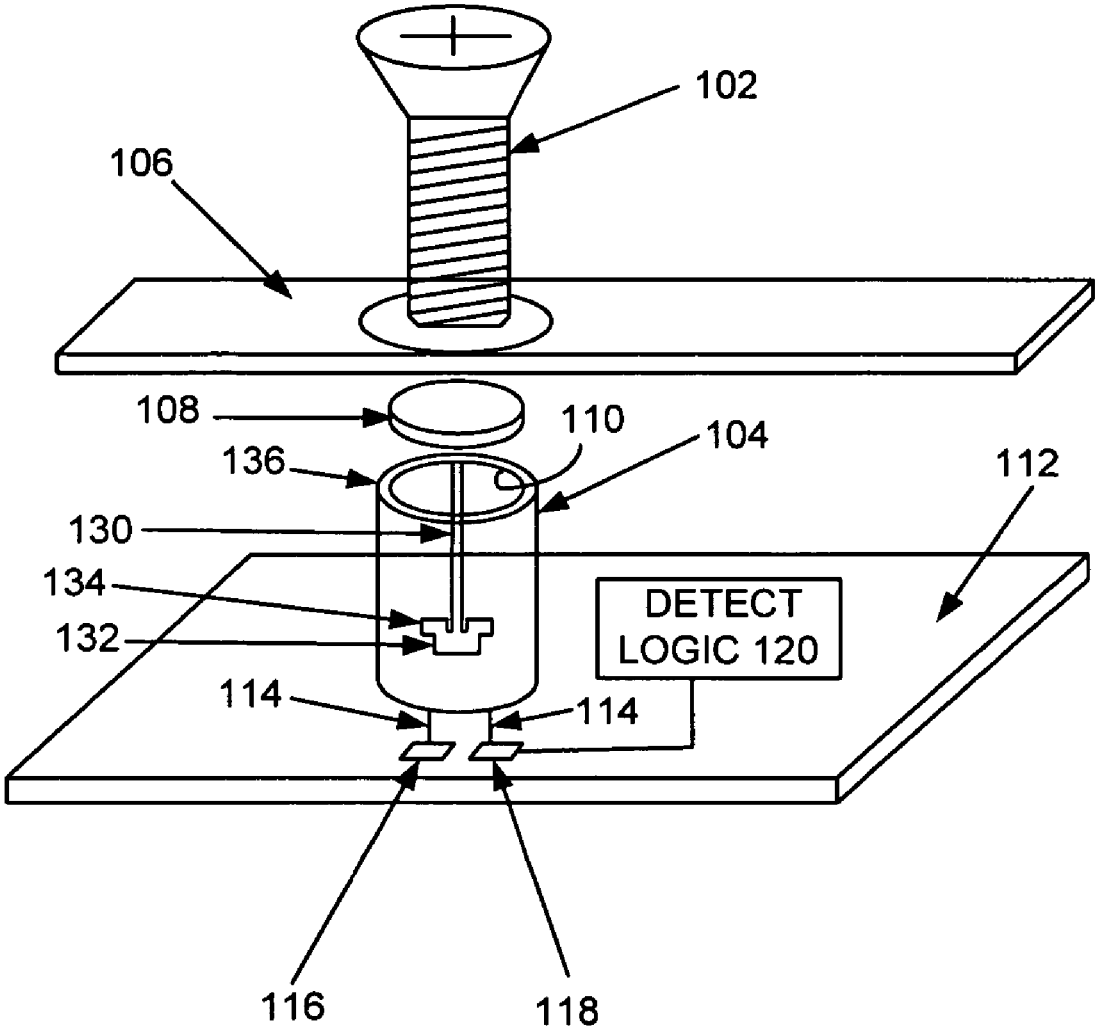
FIG. 1 is a simplified exploded and partly schematic view not to scale of apparatus for identifying product tampering in accordance with the preferred embodiment.

Having reference now to the drawings, in FIG. 1, there is shown apparatus generally designated by the reference character 100 for identifying product tampering in accordance with the preferred embodiment. FIG. 1 shows a simplified, exploded and partly schematic view of the product tampering identifying apparatus 100. Product tampering identifying apparatus 100 includes a mechanical fastening screw 102 and sleeve 104, which once inserted into a package, cannot be taken out and re-inserted without showing evidence of tampering.

The mechanical fastening screw 102 is inserted through an external product case 106, into the sleeve 104 of the preferred embodiment. For product assembly, a follower disk 108 is located in a cavity 110 defined by sleeve 104. Before the mechanical fastening screw 102 is installed during product assembly, the sleeve 104 of the preferred embodiment already is mounted to a printed circuit board (PCB) 112, including a pair of electrical connection paths 114 between predefined sleeve locations, for example, as shown in either FIG. 6 or FIG. 7, and a pair of surface pads 116, 118 on the PCB. A detect logic block 120 is connected to a surface pad 118 for identifying product tampering in accordance with the preferred embodiment by an electrical detection method. For example, detect logic block 120 can detect current flow for identifying product tampering. Detect logic block 120 can detect current flow in a simple conventional way, such as to light an LED, for instance, or in a more complex way, for example, setting a bit in a diagnostic mode register to identify product tampering.

FIG. 1 shows follower disk 108 in simplified form. A first exemplary movable follower disk 200 of a preferred embodiment is illustrated and described with respect to FIG. 2, and FIGS. 3-5. Another exemplary follower disk 1200 of a preferred embodiment is illustrated and described with respect to FIGS. 12-14.

As shown in FIG. 1, the sleeve 104 contains a channel 130, a normal assembled slot 132, and a final resting slot 134 defined within a wall 136 of the sleeve.

Figure 2:
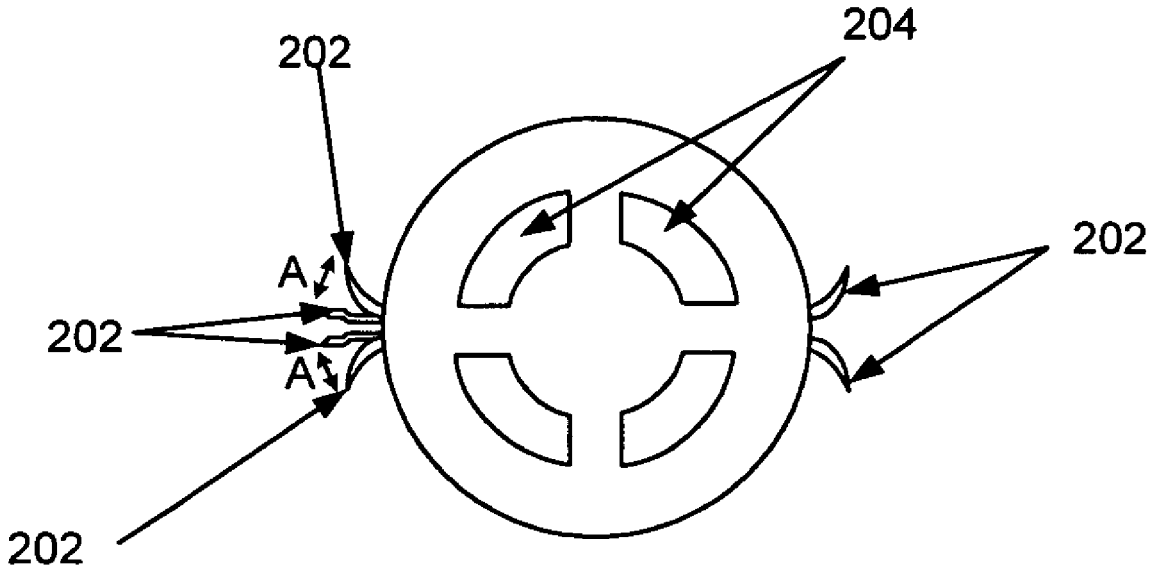
FIG. 2 is a plan top view not to scale of an exemplary internal follower disk with compressible spring followers of the apparatus of FIG. 1 in accordance with the preferred embodiment.

Referring also to FIG. 2, the movable follower disk 200 includes at least one pair of compressible spring followers 202 with two pairs of compressible spring followers 202 shown extending outwardly on opposed sides of the follower disk. On one side of the movable follower disk 200 a pair of arrows labeled A indicates the movement of the compressible spring followers 202 shown in both a compressed, first state during product assembly and a relaxed and uncompressed outwardly extending state after product tampering.

The compressible spring followers 202 are slideably received downwardly within the channel 130 when the mechanical fastening screw 102 is being inserted during product assembly. The compressible spring followers 202 are received within the normal assembled slot 132 when the mechanical fastening screw 102 is fully inserted following product assembly. Then if the screw 102 is removed, the compressible spring followers 202 engage the final resting slot 134 to indicate tampering.

Figure 8:
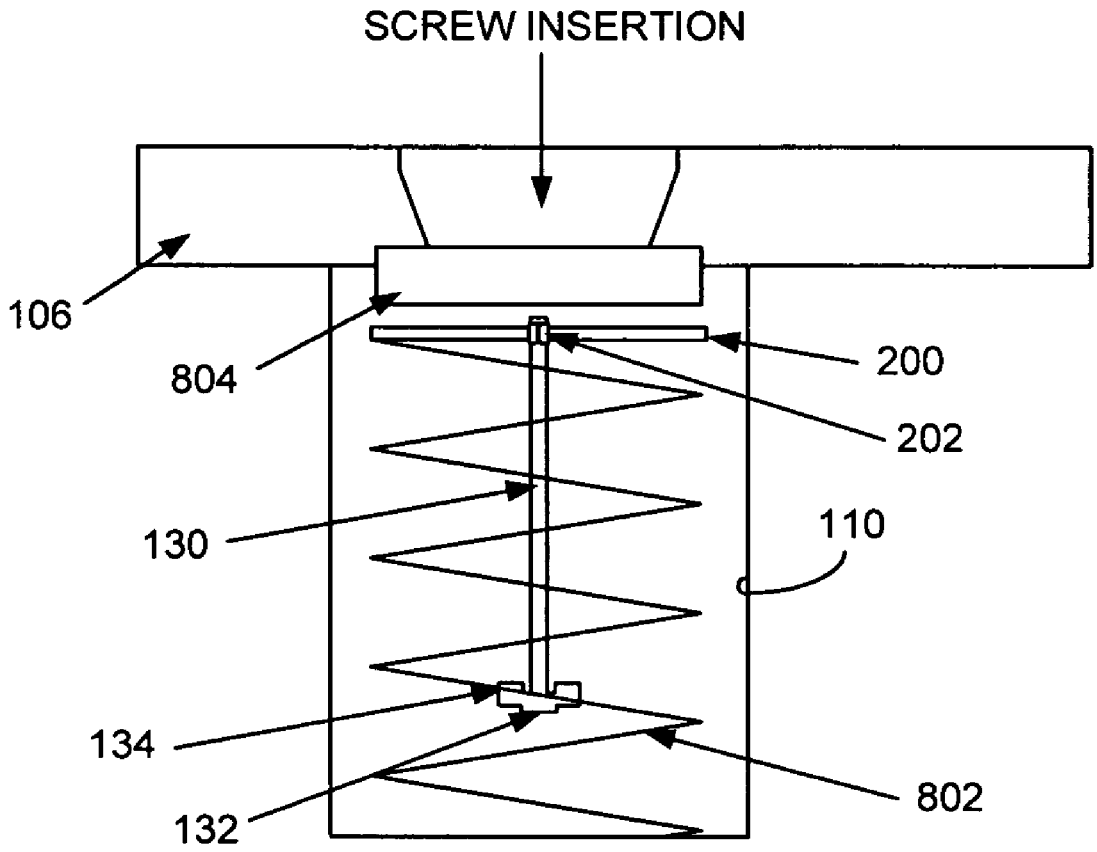
FIGS. 8-10 illustrate initial assembly of apparatus for identifying product tampering of FIG. 1 in accordance with the preferred embodiment.
Figure 9:
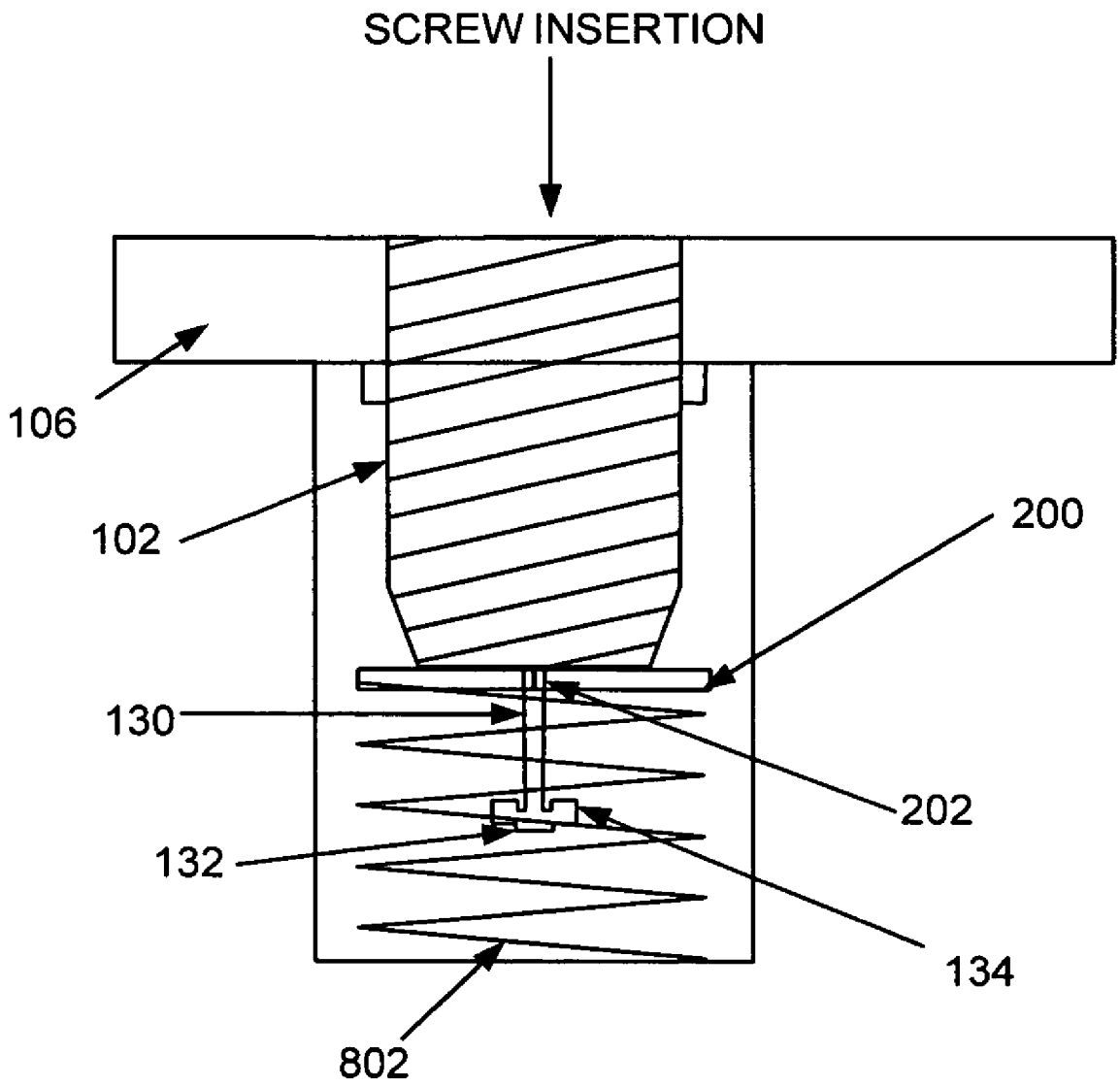
Figure 10:
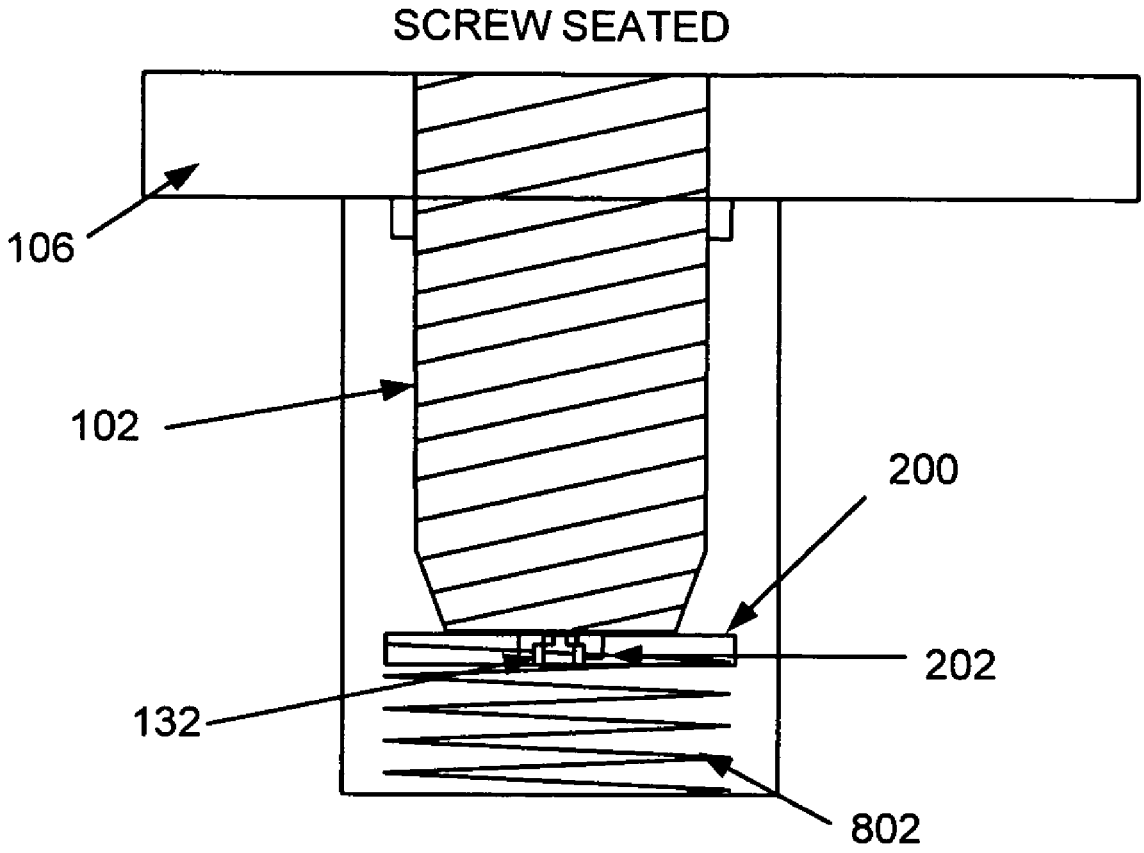

When the mechanical fastening screw 102 is removed, the compressible spring followers 202 of the follower disk settle into the final resting slot 134 due to the counter-spring force and are latched into the final resting slot 134, for example, as illustrated and described with respect to FIGS. 8-10. Electrically detecting product tamper can be easily accomplished with the spring followers 202 that once in the final resting slot 134, for example, connect to electrical pads in the sleeve then allowing current flow.

Apparatus 100 allows for the external case 106 of the product to be free of labels and seals, and can be integrated directly into the external packaging. Apparatus 100 advantageously includes electrical notification that prevents violator knowledge of the tamper-detection and can be used to provide mechanical notification of product tampering.

For example, as shown in FIG. 2, a plurality of cutout portions 204 or slots 204 are provided in a generally central area of the internal follower disk 200 to allow for visible deformation of the internal follower disk 200 after the device has been tampered-with and the mechanical fastening screw 102 is reinstalled. It should be understood that various other methods of alerting service personnel to tampering can also be achieved with other mechanical solutions.

Figure 3:
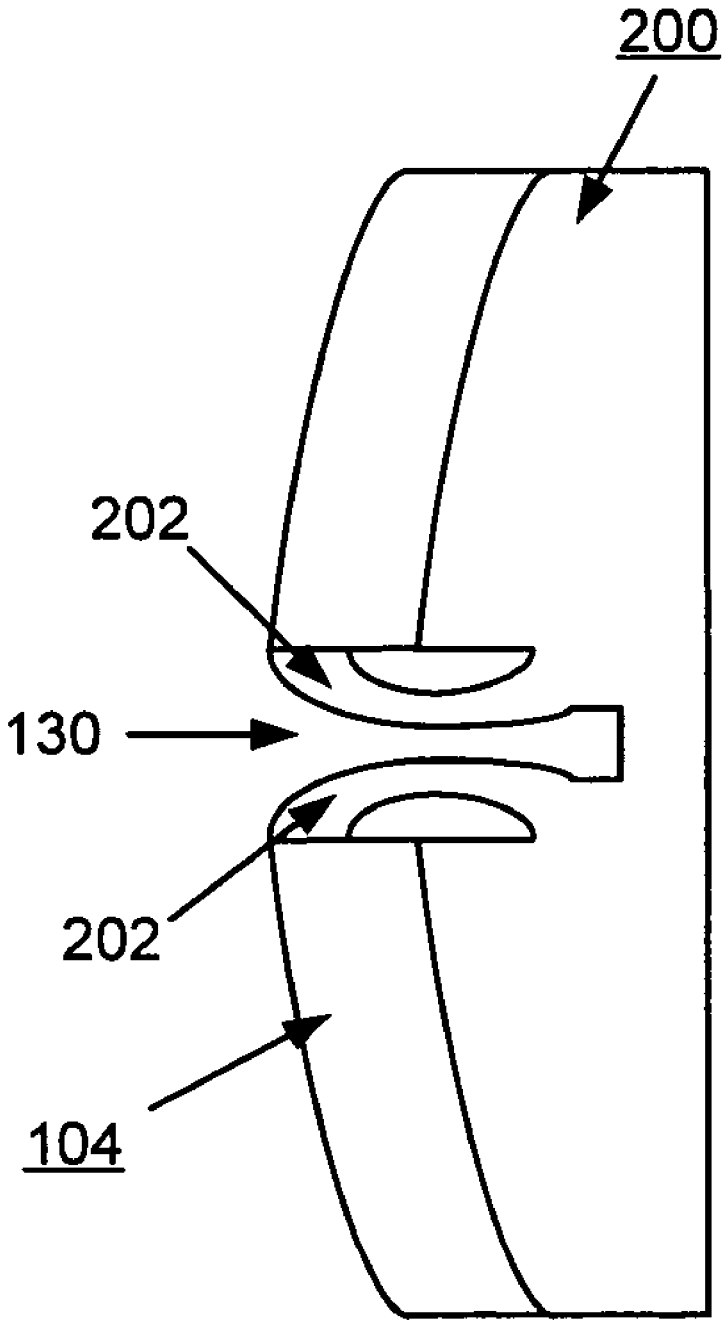
FIGS. 3-5 are fragmentary detailed views illustrating the internal follower disk of FIG. 2 with the apparatus of FIG. 1 with the compressible spring followers in a sleeve channel during initial assembly and with the compressible spring followers engaging a final resting slot after a mechanical fastening screw is removed to identify product tampering in accordance with the preferred embodiment.
Figure 4:
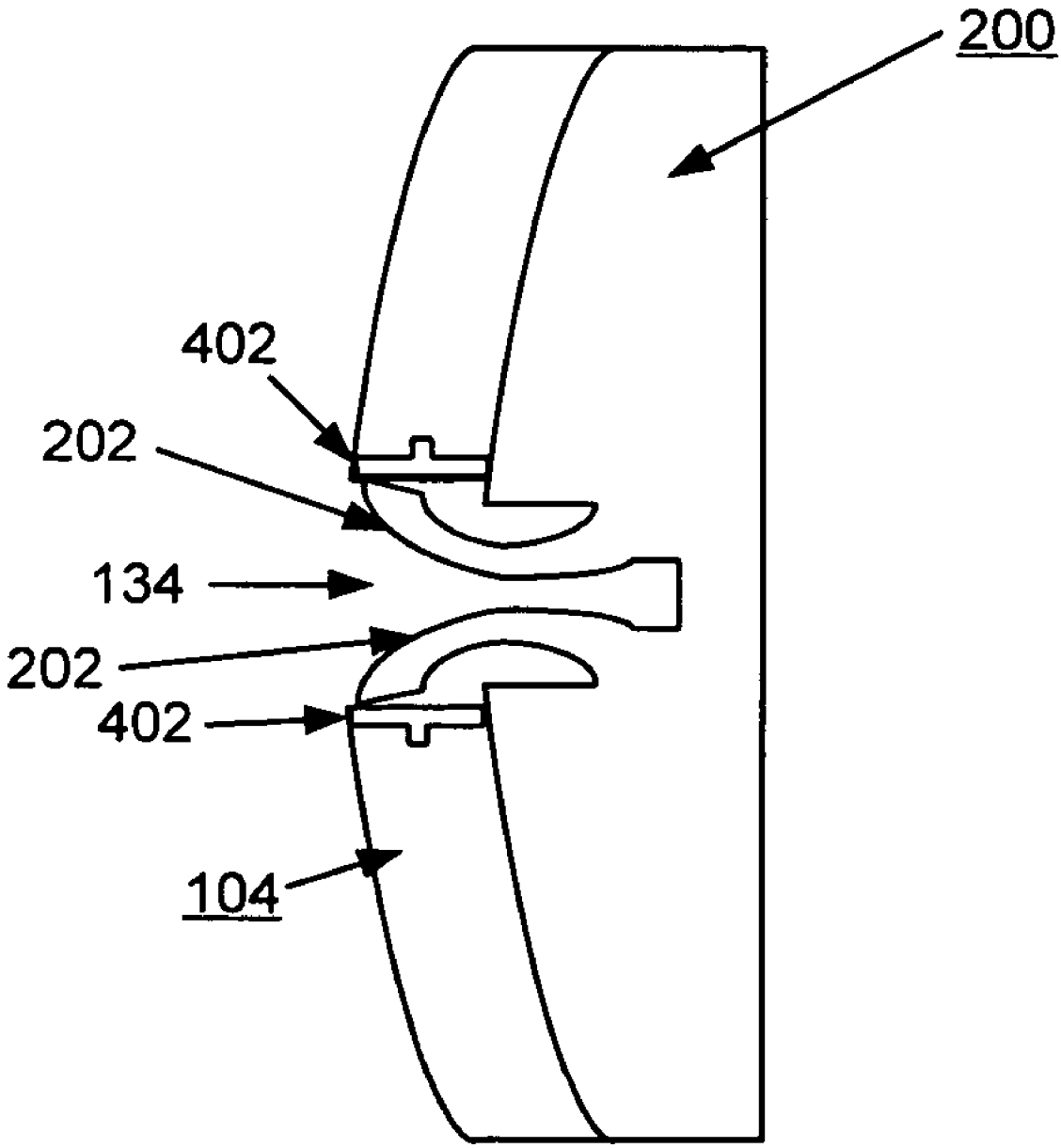
Figure 5:
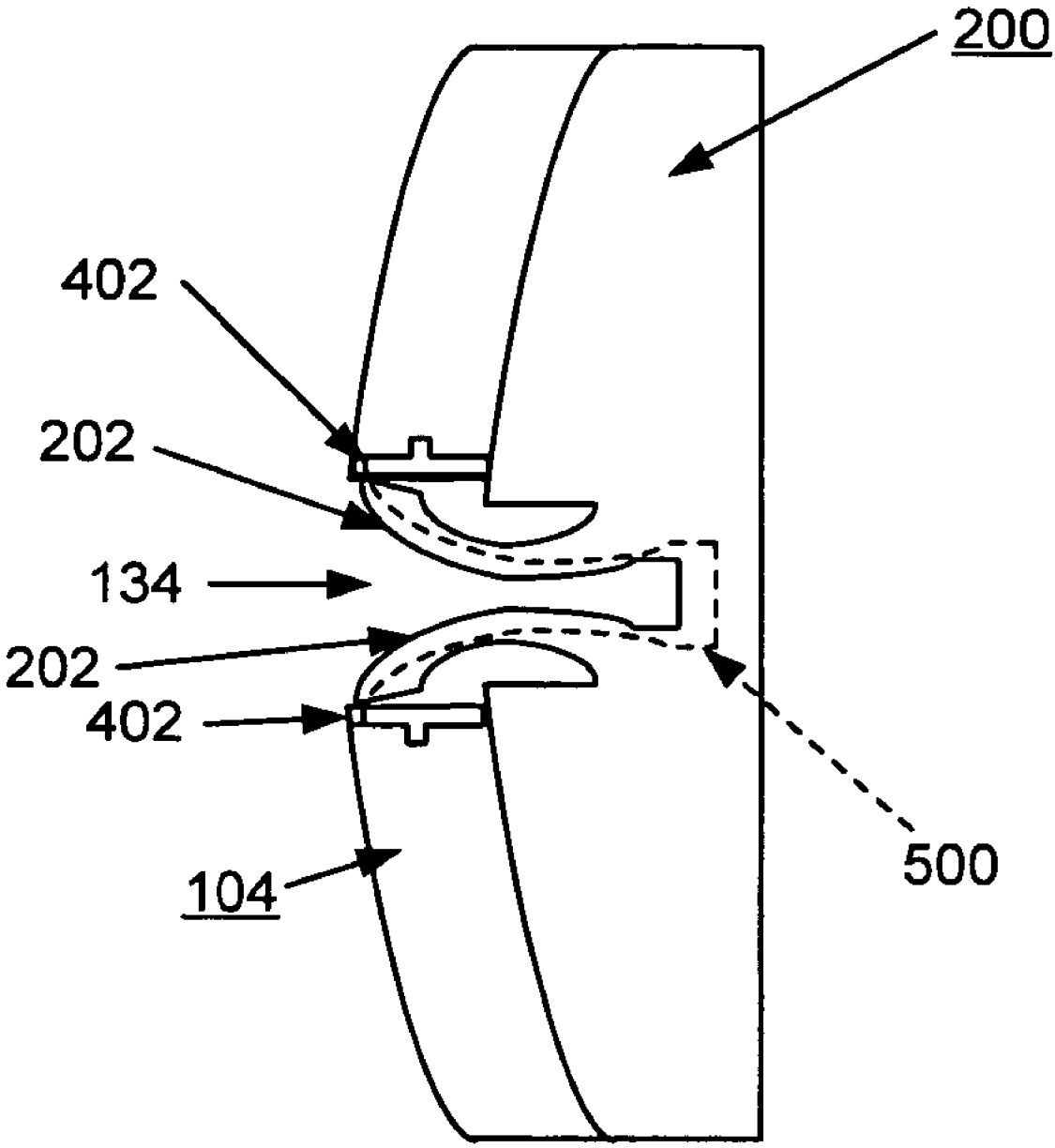

As shown in FIG. 2, the compressible spring followers 202 are compressed inward for initial assembly as illustrated in FIG. 3, and then relaxed and electrically engaged after tampering, as illustrated in FIGS. 4 and 5.

Referring now to FIGS. 3-5, there are shown fragmentary views of the internal follower disk 200 with the compressible spring followers 202 together with the sleeve 104 of the preferred embodiment.

In FIG. 3 there is shown an initial assembly step generally designated by the reference character 300 with the spring followers 202 shown compressed during the initial assembly. The compressible spring followers 202 are received within the sleeve channel 130 during the initial assembly step 300.

In FIGS. 4 and 5, there is shown a final tampering indicating step generally designated by the reference character 400 with the spring followers 202 shown engaging the final resting slot 134 after the mechanical fastening screw 102 has been removed. The final tamper indicating step 400 identifies product tampering in accordance with the preferred embodiment. A pair of contact pads 402 is provided with the sleeve 104 inside the final resting slot 134. In FIG. 5, a current path is indicated by a dotted line labeled 500 provided between the contact pads 402 electrically engaged with the spring followers 202 and through the follower disk 200.

Figure 6:
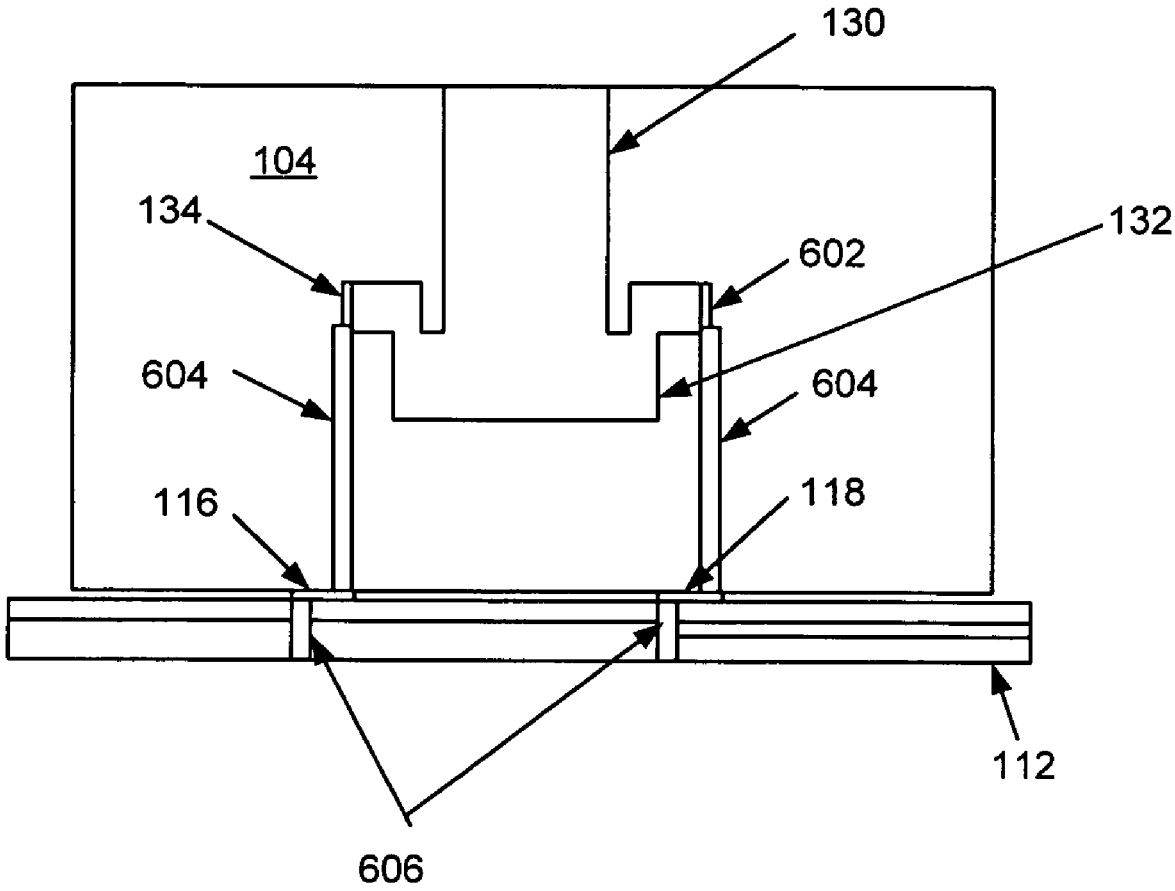
FIGS. 6 and 7 illustrate alternative embodiments for electrical connection to PCB respectively where electrical connection is evidence of product tampering, and where electrical disconnection is evidence of product tampering in accordance with the preferred embodiments.
Figure 7:
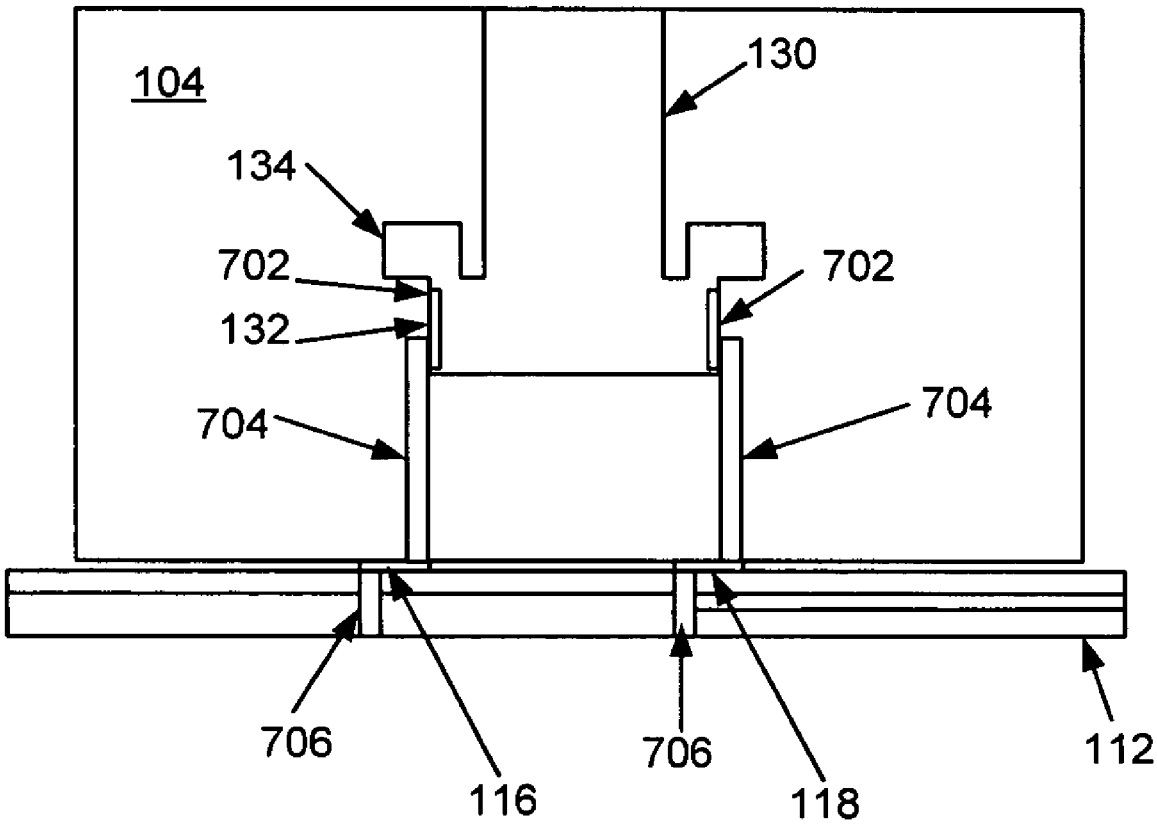

Referring also to FIGS. 6 and 7, there are shown alternative embodiments respectively generally designated by the reference character 600 and 700 for electrical connection to the printed circuit board (PCB) 112. Normal assembly techniques are used to embed electrical connections in the external sleeve 104 of the invention and to the PCB 112.

Referring to FIG. 6, in the first embodiment 600, electrical connection is evidence of product tampering in accordance with one preferred embodiment. A pair of contact pads 602 is provided with the sleeve 104 inside the final resting slot 134, each together with a conductive path 604 to the pair of contact pads 116, 118 on the printed circuit board 112. A pair of conductive vias 606 is shown connected to the pair of contact pads 116, 118 on the printed circuit board 112, for example, for connection to the detect logic 120. When the mechanical fastening screw 102 has been removed, the spring followers 202 engage the contact pads 602 providing electrical connection to the contact pads 116, 118 on the printed circuit board 112.

Referring to FIG. 7, in the second embodiment 700 electrical disconnection is evidence of product tampering in accordance with another preferred embodiment. A pair of contact pads 702 is provided with the sleeve 104 inside the normal assembled slot 132, each together with a conductive path 704 to the pair of contact pads 116, 118 on the printed circuit board 112. A pair of conductive vias 706 is shown connected to the pair of contact pads 116, 118 on the printed circuit board 112, for example, for connection to the detect logic 120. When the mechanical fastening screw 102 has been removed, the spring followers 202 move into the final resting slot 134 and are disconnected from the contact pads 702, breaking the electrical connection or providing electrical disconnection from the contact pads 116, 118 on the printed circuit board 112.

FIGS. 8-10 illustrate the initial assembly of apparatus for identifying product tampering of FIG. 1 in accordance with the preferred embodiment.

Referring to FIG. 8, there is shown an initial assembly step generally designated by the reference character 800 of the assembly sequence. FIG. 8 shows the initial position of the follower disk 200, and an uncompressed spring 802 in the sleeve cavity 110 located below the follower disk 200. Note the initial compressed position of the spring followers 202 on the disk 200 that are received within the sleeve channel 130.

Referring to FIG. 9, there is shown a next assembly step generally designated by the reference character 900 of the assembly sequence. As the screw 102 is initially inserted, the follower disk 200 is pushed downward towards the bottom of the sleeve 104.

Referring to FIG. 10, there is shown a full-assembly step generally designated by the reference character 1000 of the assembly sequence. The screw 102 has been completely set, and the spring followers 202 are released from the channel 130, into a lesser-compressed state within slot 132, and are ready to detect tampering. Note that the spring 802 at the bottom of the sleeve 106 is now compressed, providing counter force to the follower disk 202, moving it upward if the screw 102 is removed.

Figure 11:
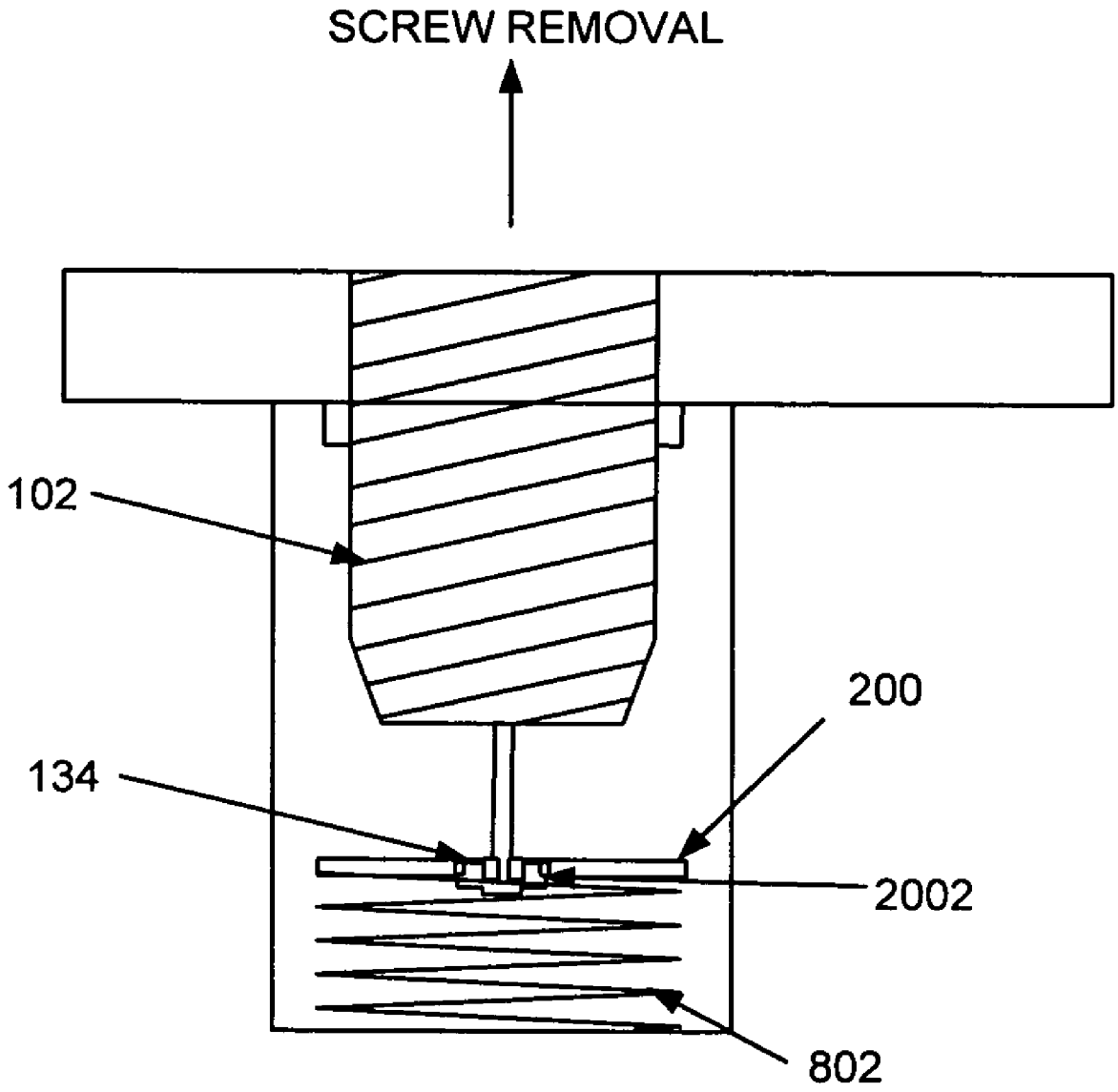
FIG. 11 illustrates the apparatus of FIG. 1 after removing a mechanical fastening screw of the apparatus of FIG. 1 to identify product tampering in accordance with the preferred embodiment.

Referring now to FIG. 11, there is shown a tampering step generally designated by the reference character 1100. The tampering step 1100 results from the removal of the screw 102 by an unauthorized user. Removal of the screw 102 causes the follower disk 200 to rise, locking the spring followers 202 into the final resting slot 134, and allowing detection by electrical detect logic 120.

Referring now to FIGS. 12, 13A, 13B, and 14, there is shown an alternative embodiment of a follower disk generally designated by the reference character 1200 for the apparatus 100 for identifying product tampering in accordance with the preferred embodiment.

Figure 12:
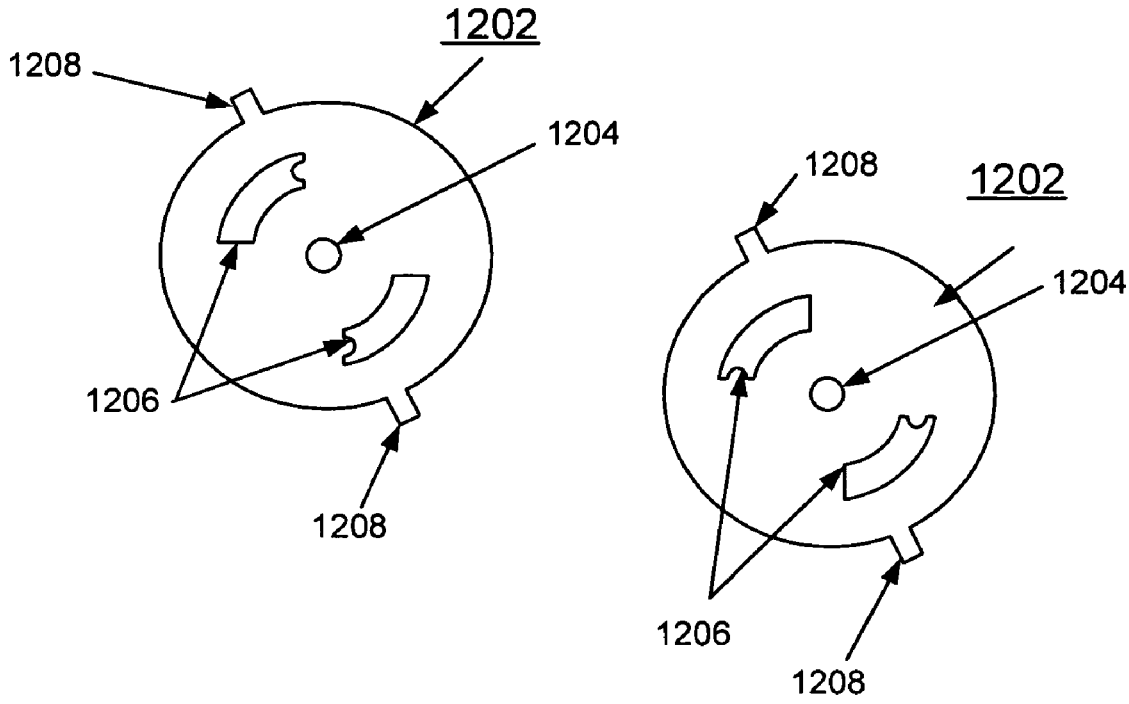
FIGS. 12, 13A, 13B, 14, and 15 illustrate an alternative embodiment of a follower disk and an exemplary sleeve chamber for the apparatus for identifying product tampering of FIG. 1 in accordance with the preferred embodiment.

Referring to FIG. 12, the spring follower disk 1200 includes a pair of substantially identical disks 1202, each including a central opening 1204 for mounting the disks 1202 in a stack. Each disk 1202 includes a pair of slots 1206 and as shown in FIGS. 13A and 13B a spring 1302 is mounted in the slot to force a spring follower 1208 to latch into place when seated, and when the screw 102 is removed during tampering.

Figure 13A:
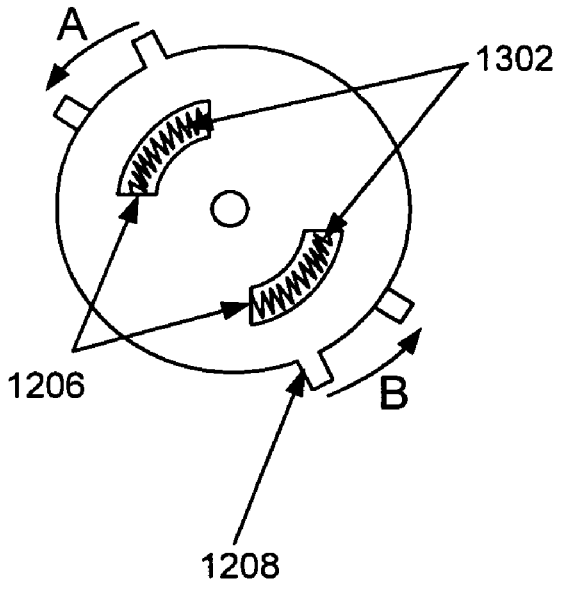
Figure 13B:
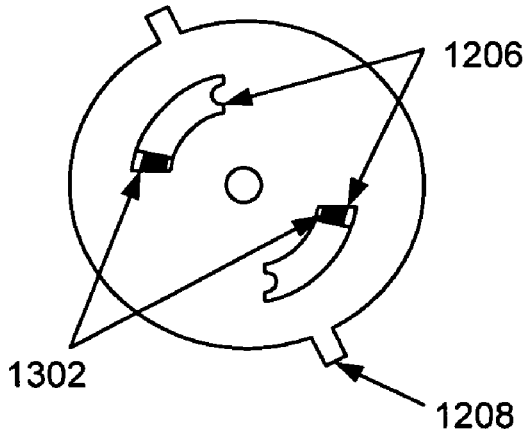
Figure 14:
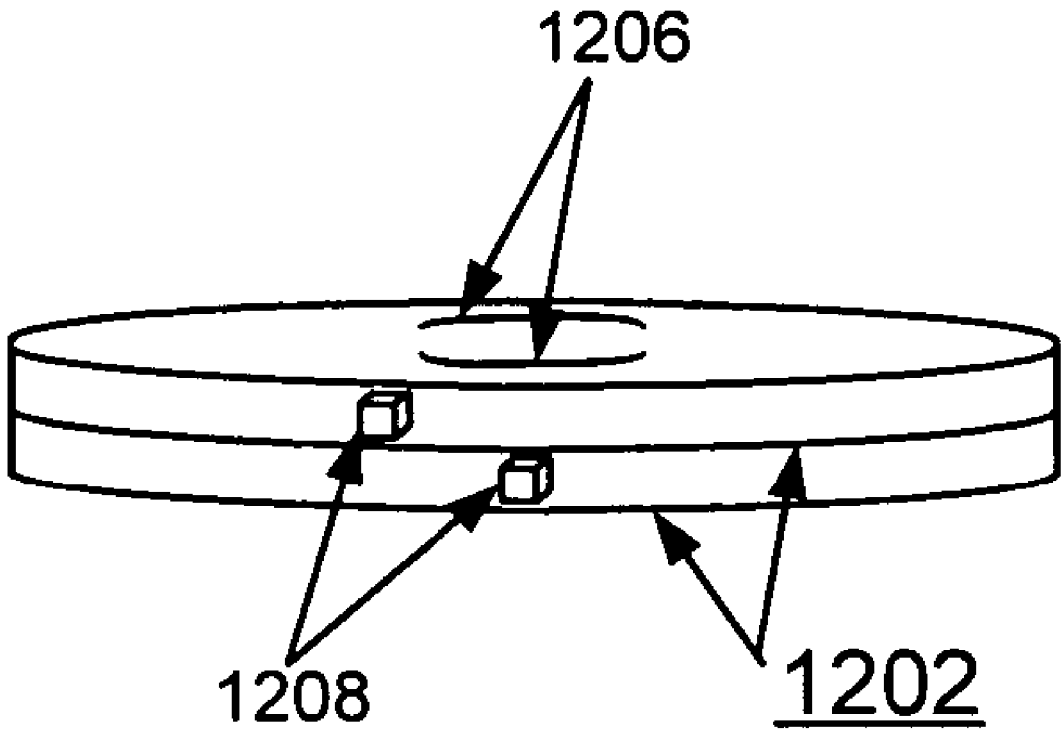
Figure 15:
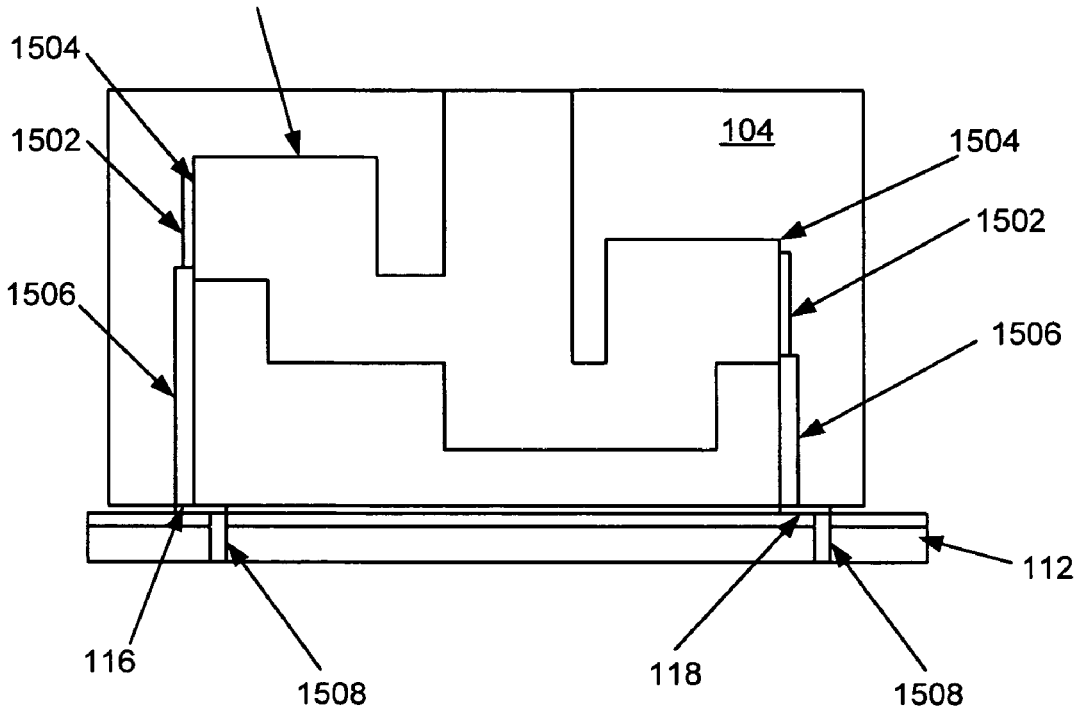

Referring also to FIGS. 13A and 13B and FIG. 14, the disks 1202 are connected with a rivet 1304 or other similar connector in the center to allow for the free rotation of each disk 1202. In FIG. 14, an isometric view of the spring follower disk 1200 is provided with the follower disks 1202 stacked. During assembly, the springs 1302 will be compressed as shown in FIG. 13A and the springs 1302 rotate the disks 1202 in opposite directions as indicated by arrows labeled A and B. During assembly, the follower nodes 1208 will move vertically down the channel 130 in the external sleeve 130, until being seated in a chamber 1500, for example, as shown in FIG. 15. Then the spring 1302 will then be uncompressed as shown in FIG. 13B.

FIG. 15 illustrates an exemplary external sleeve chamber geometry generally designated by the reference character 1500 for spring follower disk 1200 to allow both follower nodes 1208 or latches 1208 to engage a respective contact pad 1502. The pair of contact pads 1502 is provided with the sleeve 104 inside the respective final resting slot 1504, each together with a conductive path 1506 to the pair of contact pads 116, 118 on the printed circuit board 112. A pair of conductive vias 1508 is shown connected to the pair of contact pads 116, 118 on the printed circuit board 112, for example, for connection to the detect logic 120. When the mechanical fastening screw 102 has been removed, the spring follower nodes 1208 engage the contact pads 1502 providing electrical connection to the contact pads 116, 118 on the printed circuit board 112.

While the present invention has been described with reference to the details of the embodiments of the invention shown in the drawing, these details are not intended to limit the scope of the invention as claimed in the appended claims.

What is claimed is:

1. Apparatus for identifying product tampering comprising:

a sleeve defining a cavity; said sleeve including a channel and a final resting slot defined within a sleeve wall;

a mechanical fastening screw received within said sleeve cavity during product assembly, and a movable follower disk received within said sleeve cavity and engaged by said mechanical fastening screw; said movable follower disk including compressible spring followers slideably received within said channel when said mechanical fastening screw is inserted; and said compressible spring followers engaging said final resting slot to indicate tampering when said mechanical fastening screw is removed.

2. Apparatus for identifying product tampering as recited in claim 1 wherein said mechanical fastening screw is received through an aperture in an external product cover.

3. Apparatus for identifying product tampering as recited in claim 1 includes a spring received within said sleeve cavity opposing the mechanical fastening screw, and wherein said compressible spring followers engage the final resting slot due to a counter force of said spring when said mechanical fastening screw is removed.

4. Apparatus for identifying product tampering as recited in claim 1 wherein said movable follower disk includes a plurality of interior cutout portions for enabling deformation of said movable follower disk when said mechanical fastening screw is removed and reinserted.

5. Apparatus for identifying product tampering as recited in claim 1 includes a circuit board supporting said sleeve.

6. Apparatus for identifying product tampering as recited in claim 5 wherein said circuit board includes a first pair of electrically conductive pads.

7. Apparatus for identifying product tampering as recited in claim 6 wherein said sleeve includes a second pair of electrically conductive pads; and said sleeve includes a pair of conductive paths connecting said first pair of electrically conductive pads to said second pair of electrically conductive pads.

8. Apparatus for identifying product tampering as recited in claim 1 wherein said second pair of electrically conductive pads are electrically connected by said movable follower disk when said compressible spring followers engage said final resting slot to indicate tampering.

9. Apparatus for identifying product tampering as recited in claim 1 wherein said second pair of electrically conductive pads are electrically disconnected by said movable follower disk when said compressible spring followers engage said final resting slot to indicate tampering.

10. Apparatus for identifying product tampering as recited in claim 1 wherein said movable follower disk includes a pair of follower disks, said pair of follower disks mounted together in a stack and each said follower disk having a pair of spring-receiving slots and said compressible spring followers including a pair of outwardly extending tabs formed on each said follower disk and said sleeve including a pair of said channels receiving said tabs.

11. Apparatus for identifying product tampering as recited in claim 10 includes a spring mounted in a respective one of said spring slots and wherein said springs are compressed when said mechanical fastening screw is inserted into said sleeve.

12. Apparatus for identifying product tampering as recited in claim 1 wherein said movable follower disk is formed of electrically conductive material.

13. Apparatus for identifying product tampering as recited in claim 1 wherein said compressible spring followers engaging said final resting slot indicate tampering by enabling a current flow.

14. A method for identifying product tampering comprising the steps of:

providing a sleeve defining a cavity and said sleeve including a channel and a final resting slot defined within a sleeve wall;

installing a mechanical fastening screw received within said sleeve cavity during product assembly, and providing a movable follower disk received within said sleeve cavity and engaged by said mechanical fastening screw and said movable follower disk including compressible spring followers slideably received within said channel while said mechanical fastening screw being inserted; said compressible spring followers engaging said final resting slot to indicate tampering when said mechanical fastening screw is removed; and electrical detecting said compressible spring followers engaging said final resting slot to indicate tampering.

15. A method for identifying product tampering as recited in claim 14 wherein installing said mechanical fastening screw includes inserting said mechanical fastening screw through an aperture in an external product cover.

16. A method for identifying product tampering as recited in claim 14 wherein providing said movable follower disk includes forming said movable follower disk including said compressible spring followers of electrically conductive material.

17. A method for identifying product tampering as recited in claim 14 includes providing a current path to an electrical detect logic from a pair of electrically conductive pads located in said final resting slot for electrically connecting to said compressible spring followers.

18. A method for identifying product tampering as recited in claim 17 wherein electrical detecting said compressible spring followers engaging said final resting slot includes detecting a current flow.

19. A method for identifying product tampering as recited in claim 14 includes providing a current path to an electrical detect logic from a pair of electrically conductive pads located outside said final resting slot for electrically disconnecting from said compressible spring followers with said compressible spring followers engaging said final resting slot.

20. A method for identifying product tampering as recited in claim 19 wherein electrical detecting said compressible spring followers engaging said final resting slot includes detecting no current flow.

* * * * *